US005853259A

United States Patent [19]

Murray, Jr.

[11] Patent Number: 5,853,259

[45] Date of Patent: Dec. 29, 1998

[54] BINDER LABELING ASSEMBLY

[76] Inventor: George E. Murray, Jr., 706 Charles City Dr., Arlington, Tex. 76018

[21] Appl. No.: 982,795

[22] Filed: Dec. 2, 1997

[51] Int. Cl.[6] ..... B42F 21/06

[52] U.S. Cl. ..... 402/3; 402/79; 281/34; 281/29; 283/36; 283/40

[58] Field of Search ..... 402/3, 79, 80 R; 281/22, 29, 31, 34, 35, 36, 37, 38; 283/36, 37, 38, 39, 40, 41, 42, 43

[56] References Cited

U.S. PATENT DOCUMENTS

| | | | |
|---|---|---|---|
| 630,215 | 8/1899 | Gross . | |
| 884,573 | 4/1908 | Detmers . | |
| 998,646 | 7/1911 | Simons . | |
| 1,029,280 | 6/1912 | Davidson | 281/34 |
| 1,067,531 | 7/1913 | MacGregor . | |
| 1,571,479 | 2/1926 | Huber . | |
| 1,697,523 | 1/1929 | Dawson . | |
| 1,943,022 | 1/1934 | Koster | 40/158 |
| 2,509,841 | 5/1950 | Rose | 283/40 |
| 2,576,783 | 11/1951 | Dewey | 40/16 |
| 2,764,161 | 8/1956 | Sobesky | 129/1 |
| 4,033,061 | 7/1977 | Schulhof | 40/158 |
| 4,079,533 | 3/1978 | Rohner | 283/36 X |
| 4,302,032 | 11/1981 | Randall | 281/29 |
| 5,174,606 | 12/1992 | Hure | 281/45 |
| 5,447,333 | 9/1995 | Kuhns | 281/29 |
| 5,468,085 | 11/1995 | Kline | 402/79 |
| 5,720,564 | 2/1998 | Winzen | 281/29 X |

*Primary Examiner*—Andrea L. Pitts
*Assistant Examiner*—Henry W. H. Tsai
*Attorney, Agent, or Firm*—Goldstein & Canine

[57] ABSTRACT

A binder labeling assembly used with a report binder having sheets retained by binder posts for facilitating quick and easy identification of the report binder. The binder labeling assembly comprises a front cover having a cutout window, a cover label for the rear edge, and a tab label for the rear edge, to permit instant identification in situations such as the following: when the report binders are lying in it horizontal position, when the report binders are arranged in the upright position on the bookshelves, or when the report binders are stacked on top of each other in storage boxes or in mailing packages.

6 Claims, 3 Drawing Sheets

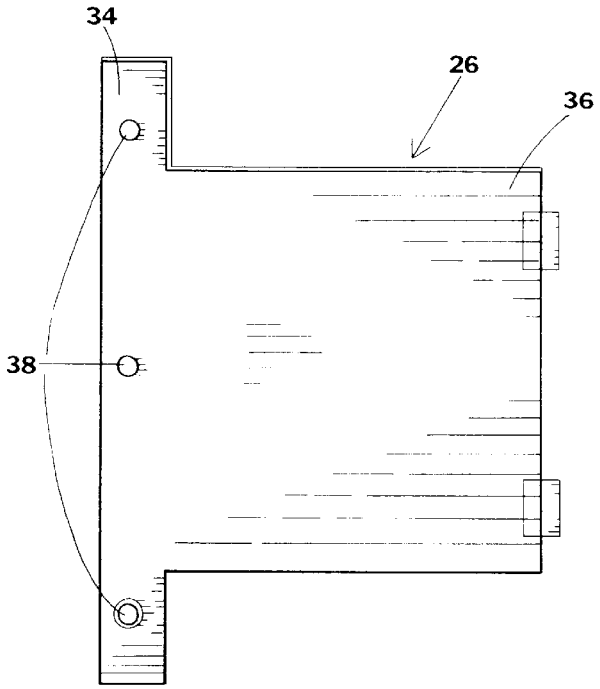
FIG.2
FIG.3
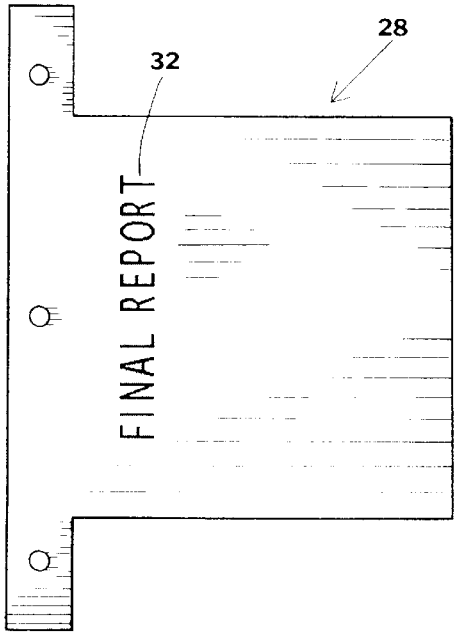
FIG.4
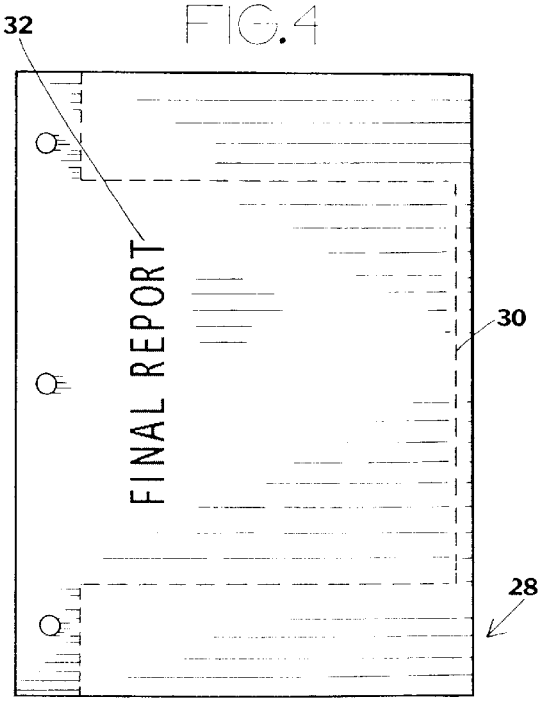

BINDER LABELING ASSEMBLY

BACKGROUND OF THE INVENTION

The invention relates to a binder labeling assembly. More particularly, the invention relates to a binder labeling assembly which employs a front cover having a cutout window, a rear edge cover label, and rear edge tab label designed to facilitate quick and easy identification of the report binder.

Report binders are often arranged in the usual upright position on bookshelves or are packed fairly tightly in storage boxes or mailing packages. When they are not properly labeled, they are difficult to identify without taking the individual report binder down from the shelf or out of storage boxes to read the printed matter inside the front cover.

Accordingly, a variety of different types of labeling devices have been designed to enable determination of the content by just looking at the cover or label on the binder. For example, U.S. Pat. No. 884,573 to Detmers discloses a labeling device which is laterally detachable from the binding post. Likewise, U.S. Pat. No. 998,646 to Simons discloses a hinged binding tag which is attachable to the posts of a binder. U.S. Pat. No. 2,764,161 to Sobesky discloses another label holder having a supporting flange which is attachable to the binding posts of ledger books.

A number of picture frames employ a cutout window for exhibiting a picture, a certificate or the like. For instance, U.S. Pat. No. 630,215 to Gross discloses a photograph mounting frame having an opening for displaying a picture. Likewise, U.S. Pat. No. 1,943,022 to Koster discloses a picture mount including a picture covering sheet having a window cutout. U.S. Pat. No. 4,033,061 to Schulhof discloses another display folder having a top sheet which includes a cut-away portion.

Despite all these labeling devices, there is still a further need to provide an improved binder labeling assembly. Such a binder labeling assembly should be simple to use, inexpensive to manufacture, and still provide highly visible labels which enable quick identification even when the report binders are stored on bookshelves or packed tightly in boxes.

While these units may be suitable for the particular purpose employed, or for general use, they would not be as suitable for the purposes of the present invention as disclosed hereafter.

SUMMARY OF THE INVENTION

It is an object of the invention to produce a binder labeling assembly which is simple to use, inexpensive to manufacture, and yet capable of conveying the contents of the report binder that is placed on a bookshelf or in a box without removing the binder from the shelf or the box.

It is yet another object of the invention to provide a binder labeling assembly having printable labels which can be printed using standard printing papers and printers.

It is a further object of the invention to provide a binder labeling assembly which is capable of accommodating reports having a varying number of pages or sheets, thereby facilitating the efficient use of space and uniformity in report binding for various documents.

It is still a further object of the invention to provide a binder labeling assembly wherein the rear edge tab label is made of a flexible material, thereby facilitating packing of report binders for mailing or for storage.

The invention is a binder labeling assembly for use with a report binder having sheets retained by binder posts, for facilitating quick and easy identification of the report binder. The binder labeling assembly comprises a front cover having a cutout window, a cover label for the rear edge, and a tab label for the rear edge, designed to permit instant identification in situations such as in the following: when the report binders are lying in its horizontal position, when the report binders are arranged in the upright position on the bookshelves, or when the report binders are stacked against each other in storage boxes or mailing packages.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 2 is a top plan view of the two-ply label holder of the rear edge cover label.

FIG. 3 is a top plan view of the printable label insert of the rear edge cover label in a pre-cut form.

FIG. 4 is a top plan view of an alternate embodiment of the printable label insert of the rear edge cover label having a marking to indicate cutting lines corresponding with the shape of the plastic label holder.

DETAILED DESCRIPTION OF THE PREFERRED EMBODIMENTS

Figure 1:
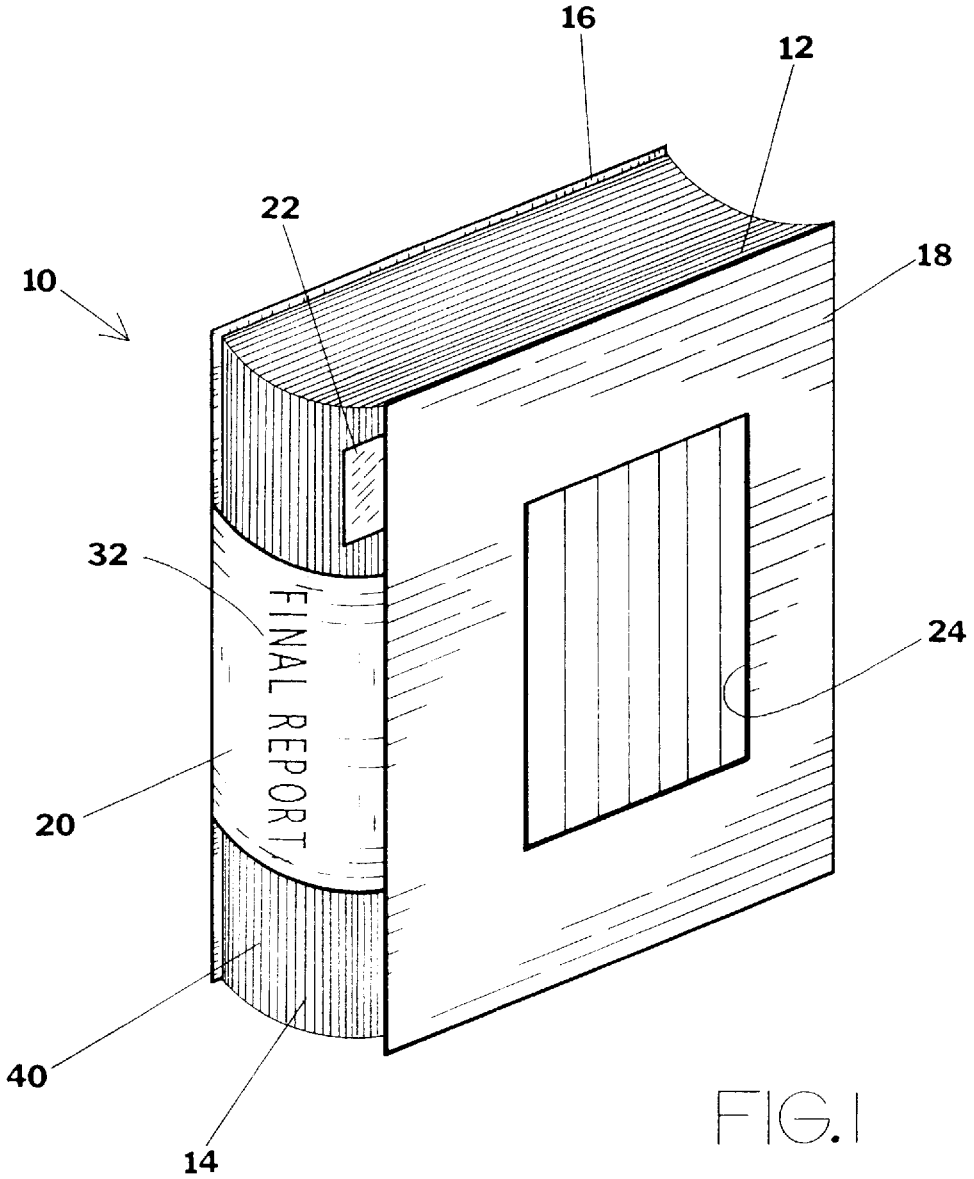
FIG. 1 is a diagrammatic perspective view of the instant invention being used with a report binder.

FIG. 1 illustrates a binder labeling assembly 10 being used with a report binder 12 having binder posts for retaining sheets of paper 14 and a back cover 16. The binder labeling assembly 10 has primary components including a front cover 18, a rear edge cover label 20, and a rear edge tab label 22, for quick and easy identification when the binders are arranged on bookshelves or are packed for storage or mailing.

The front cover 18 of the binder labeling assembly 10 has an internal central opening forming a cutout window 24. The cutout window 24 corresponds in shape and size to the portion of the cover page which is to remain visible. When the report binder 12 is lying on its back side, the cutout window 24 of the front cover 18 enables its contents to be determined without the necessity of opening the covers of the binder.

Referring to FIGS. 2, 3, and 4, the rear edge cover label 20 includes two components; a two-ply label holder 26 and a printable label insert 28. The two-ply label holder 26 is made from clear plastic sheet material. The plastic label holder 26 has an overall shape and size similar to the shape and size of standard loose leaf papers. As shown in FIG. 2, in a preferred embodiment, the plastic label holder 26 has the top and bottom portions cutout, with only a 3-hole punched strip, yet to be described, remaining in the top and bottom portions.

A pocket is formed between the two-ply plastic sheets of the label holder 26 where the label insert 28 is to be mounted. The printable label insert 28 may be pre-cut to conform to the shape of the two-ply label holder 26, as depicted in FIG. 3. Alternatively, the printable label insert 28 may have a light-colored marking or a computer paper type perforation marking 30 to indicate cutting-lines which corresponds with the shape of the plastic label holder 26, as depicted in FIG. 4. The label indication 32 may be printed on the printable label insert 28 using any conventional printers or may also be hand-written.

The rear edge cover label 20 has a first side edge 34 and a second side edge 36 and has 3-hole punched arrangement 38 along the first side edge 34 for the passage of binder posts. The rear edge cover label 20 is anchored to the binder posts at the first side edge 34 and is disposed against the rear edge 40 of the report binder 12, thereby displaying the printed label indication 32 from the hinge end or the rear edge 40 of the binder 12. The second side edge 36 of the rear edge cover label 20 can be secured to the back cover 16 of the binder 12 by adhesive means. Alternatively, a hole can be punched in the rear edge cover label 20 near the second side edge 36 so that it can be anchored to the binder post between the back cover 16 and sheets of paper 14, or the rear edge cover label 20 can be secured by any other method as would be appreciated by those skilled in the art. The mentioned methods of securing the second side edge 36 of the rear edge cover label 20 permit flexibility, accommodating reports of varying number of pages or sheets.

Figure 5:
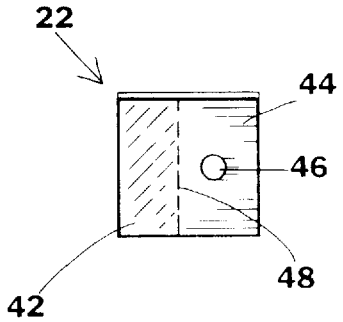
FIG. 5 is a top plan view of the rear edge tab label.
Figure 6:
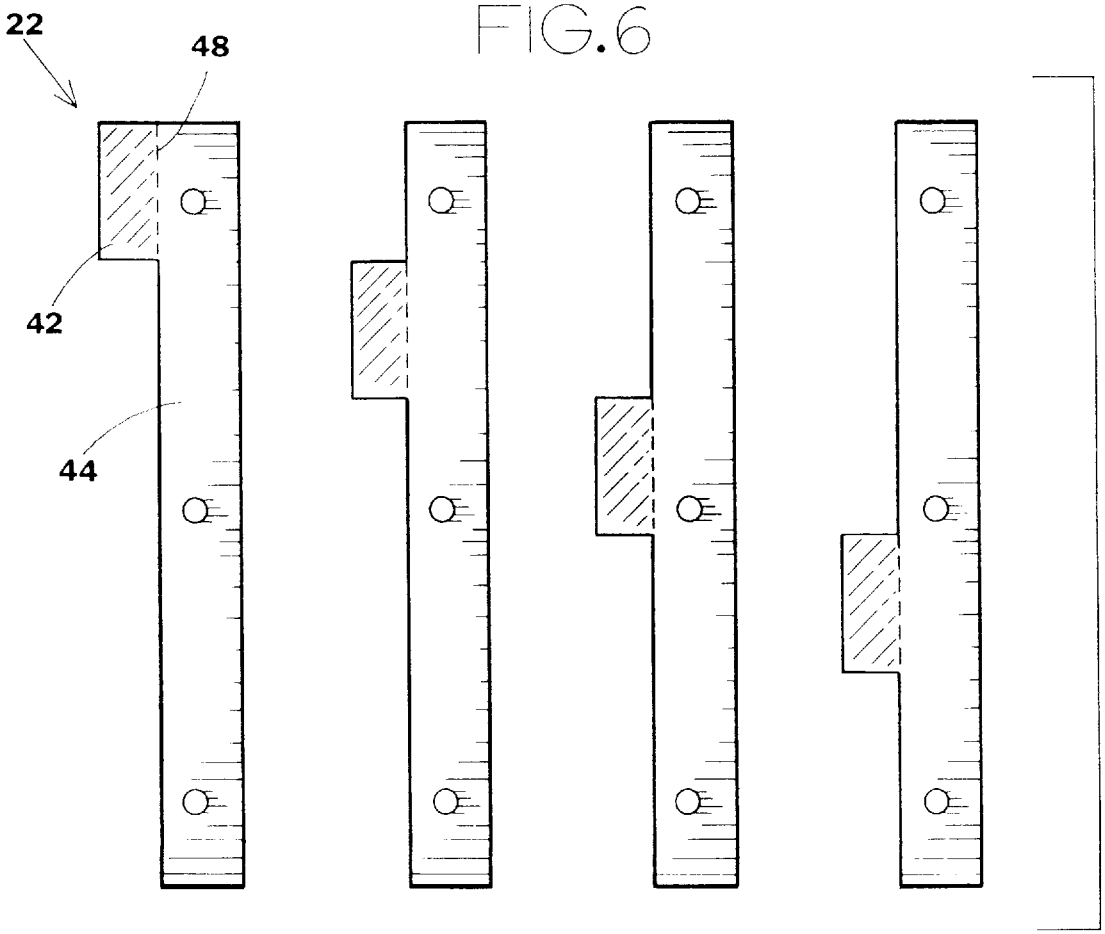
FIG. 6 is a top plan view of an alternate embodiment of the rear edge tab label.

FIG. 5 illustrates the rear edge tab label 22 made from plastic sheet material, and having a tag holder portion 42 and an anchoring portion 44. The tag holder portion 42 has a pocket where a small paper tab can be inserted. The anchoring portion 44 has a reinforced hole 46 for the passage of a binder post. Adhesive material can be used to further secure the rear edge tab label 22 and prevent it from rotating with respect to the binder post. In an alternate embodiment, the anchoring portion 44 is made of an elongated strip having a 3-hole punched arrangement providing more stability, as depicted in FIG. 6. The rear edge tab label 22 is preferably made of a resilient material permitting the tab label to bend freely at the hinge line 48, thereby preventing the tab label 22 from interfering when packing the report binder 12 for mailing or for storage.

In operation, the binder labeling assembly 10 may be used with a binder 12 having sheets retained by binding posts or by any other binder fastening means. The labeling devices employed in the binder labeling assembly 10 is arranged so that at least one label will be visible from any direction, thereby permitting instant identification. For instance, when the report binder 12 is lying in its horizontal position, the cutout window 24 of the report binder 12 enables its contents to be determined without the necessity of opening the covers of the binder 12. Moreover, when the binders 12 are arranged in the usual upright position on bookshelves, the rear edge cover label 20 is clearly visible from the hinge end or rear edge 40 of the binder 12. Furthermore, when the report binders 12 are stacked on top of each other in storage boxes or in mailing packages, the rear edge tab labels 22 enable identification without taking the individual report binder 12 out of the boxes.

Many specific details contained in the above description merely illustrate some preferred embodiments and should not be construed as a limitation on the scope of the invention.

What is claimed is:

1. A binder labeling assembly for use with a binder having sheets retained by binder posts and a back cover, for facilitating instant identification of the report binder, comprising:

a) a front cover having an internal central opening forming a cutout window, said cutout window corresponding in shape and size to the portion of a cover paper which is to remain visible;

b) a rear edge cover label comprising a two-ply label holder made of a transparent material and a printable label insert for mounting within the two-ply label holder; and c) a rear edge tab label having a tag holder portion and an anchoring portion, said tag holder portion having a pocket for receiving a small paper tab, said anchoring portion having a hole for the passage of the binder post.

2. The binder labeling assembly of claim 1, further comprising a securing means for securing the rear edge cover label against the rear edge of the report binder.

3. The binder labeling assembly of claim 2, wherein the securing means further comprises:

a) the rear edge cover label having a first side edge and a second side edge, a 3-hole punched arrangement along the first side edge of the rear edge cover label for the passage of binder posts; and b) an adhesive at the second side edge for anchoring the second side edge of the rear edge cover label to the back cover.

4. The binder labeling assembly of claim 1, wherein the printable label insert further comprises a light-colored marking for indicating cut-lines corresponding with the shape of the label holder.

5. The binder labeling assembly of claim 1, wherein the printable label insert further comprises a perforation marking for indicating cut-lines corresponding with the shape of the label holder.

6. A binder labeling method, for facilitating instant identification of a report binder having sheets retained by binder posts and a back cover, with a binder labeling assembly having a front cover, a rear edge cover label having first and second side edges, said rear edge cover label having 3-hole punched arrangement along the first side edge, and a rear edge tab label having a hole for the passage of a binder post, comprising the steps of:

a) creating an internal central opening in the front cover forming a cutout window;

b) securing the first side edge of the rear edge cover label by anchoring the 3-hole punched arrangement to the binder posts;

c) securing the second side edge of the rear edge cover label between the back cover and the sheets of the binder by using an adhesive; and d) placing a rear edge tab label through a binder post.

* * * * *